US005649559A

United States Patent [19]

Scott, Jr.

[11] Patent Number: 5,649,559

[45] Date of Patent: Jul. 22, 1997

[54] COVER SUPPORTING ERECTABLE SHELTER STRUCTURE

[76] Inventor: Nathaniel Scott, Jr., 1460 E. 40th St., Savannah, Ga. 31404

[21] Appl. No.: 746,866

[22] Filed: Nov. 18, 1996

[51] Int. Cl.[6] ..... E04H 15/18

[52] U.S. Cl. ..... 135/97; 135/157; 135/153

[58] Field of Search ..... 135/128, 130, 135/97, 157, 151, 153, 122, 156, 908, 900

[56] References Cited

U.S. PATENT DOCUMENTS

| | | | |
|---|---|---|---|
| 2,311,515 | 2/1943 | Bridge | 135/153 X |
| 2,975,792 | 3/1961 | Herbert et al. | 135/153 |
| 3,757,360 | 9/1973 | Wescott | 135/153 X |
| 3,961,638 | 6/1976 | Huddle | 135/130 X |
| 4,150,682 | 4/1979 | Ryce | 135/130 |
| 4,683,901 | 8/1987 | Mitchell | 135/97 |
| 5,167,246 | 12/1992 | Mortenson | 135/153 |
| 5,245,802 | 9/1993 | Davis | 135/97 X |

FOREIGN PATENT DOCUMENTS

| | | | |
|---|---|---|---|
| 0597134 | 8/1959 | Italy | 135/97 |
| 0569593 | 5/1945 | United Kingdom | 135/157 |

*Primary Examiner*—Lanna Mai
*Attorney, Agent, or Firm*—Willard M. Hanger

[57] ABSTRACT

A cover supporting shelter structure comprising front and rear sections arranged in back-to-back contraposition each side of a common central junction of which the respective left and right sides of each section comprise identical component parts. In one embodiment the front and rear sections are identical mirror images of each other each side of the common junction and in another embodiment, the respective front and rear sides are pivotally interconnected by rotatable arms on each side for movement of the front section between extended and rear positions relative to the rear section. The respective sections in each of the embodiments utilize identical ground support legs arranged to extend vertically in the respective left and right sides of the sections from the upper ends of which sets of pairs of side frame members are supported to extend horizontally along the respective opposite section sides with the side frame members of each pair having one end connected to a ground support leg to extend outwardly of the ground support leg in opposite directions. Cover supporting ribs extend transversely of the sections above the side frame members to which opposite end portions of the ribs are attached.

12 Claims, 4 Drawing Sheets

COVER SUPPORTING ERECTABLE SHELTER STRUCTURE

BACKGROUND OF THE INVENTION

The present invention relates broadly to erectable structures for supporting a fabric or plastic sheet cover forming a shelter.

Although the present invention described herein could have as its principal utility an erectable structure for sheltering automobiles of various sizes, it should be understood that the structure is well adapted for providing a protective shelter for boats, tractors, gardening accessories and a temporary shelter for picnicking, outdoor cooking, sleeping and recreational activities of various types.

A number of erectable cover supporting shelter structures providing temporary shelter for automobiles and the like are known in the art as exemplified by those disclosed in U.S. Pat. Nos. 2,598,940; 2,798,501; 3,465,765; 4,150,682; 4,886,083 and 4,944,321. However, the component parts of these prior known structures in general comprise relatively large parts, such as transversely extending bow members, which are bulky and not readily portable. Further, side structural members of most known erectable cover supporting structures interfere with side access to the shelter interior, such as access to the centrally located doors and interior of automobiles and vans. The height and dimensions of the known structures cannot be easily varied to provide access to vehicles of various sizes, such as trucks, pick-up trucks, vans and recreational vehicles.

SUMMARY OF THE INVENTION

The object of the invention is to provide a cover supporting erectable shelter structure of changeable height and length.

Another object of the invention is to provide a cover supporting erectable shelter structure comprising small components which can be easily erected and disassembled.

A further object of the invention is to provide a cover supporting erectable shelter structure providing maximum access to its interior from both sides.

Yet a further object of the invention is to provide a cover supporting erectable shelter structure in which the component parts of various parts of the structure are identical.

These objects have been achieved by a structure comprising front and rear sections, each having identical component parts forming the respective left and right sides of the respective front and rear sections. In one embodiment, identical front and rear sections are arranged to extend oppositely outwardly each side of a common central junction. In another embodiment, respective front and rear sections are pivotally interconnected for movement of the front section between extended and retracted positions relative to the rear section. One section of each of the two embodiments includes vertically extending ground support legs disposed in the respective left and right sides of the section from the upper ends of which a set of pairs of side frame members are supported to extend horizontally along the respective opposite section sides with the side frame members of each pair having one end connected to a ground support leg with the respective frame members of the pair extending horizontally outwardly of the ground support leg in opposite directions. Cover support ribs extend transversely of the front and rear sections between and at spaced intervals along the side frame members lying along respective left and right sides of the sections and cover retaining rods extend transversely across the respective ends of the front and rear sections.

DESCRIPTION OF THE PREFERRED EMBODIMENT

Figure 1:
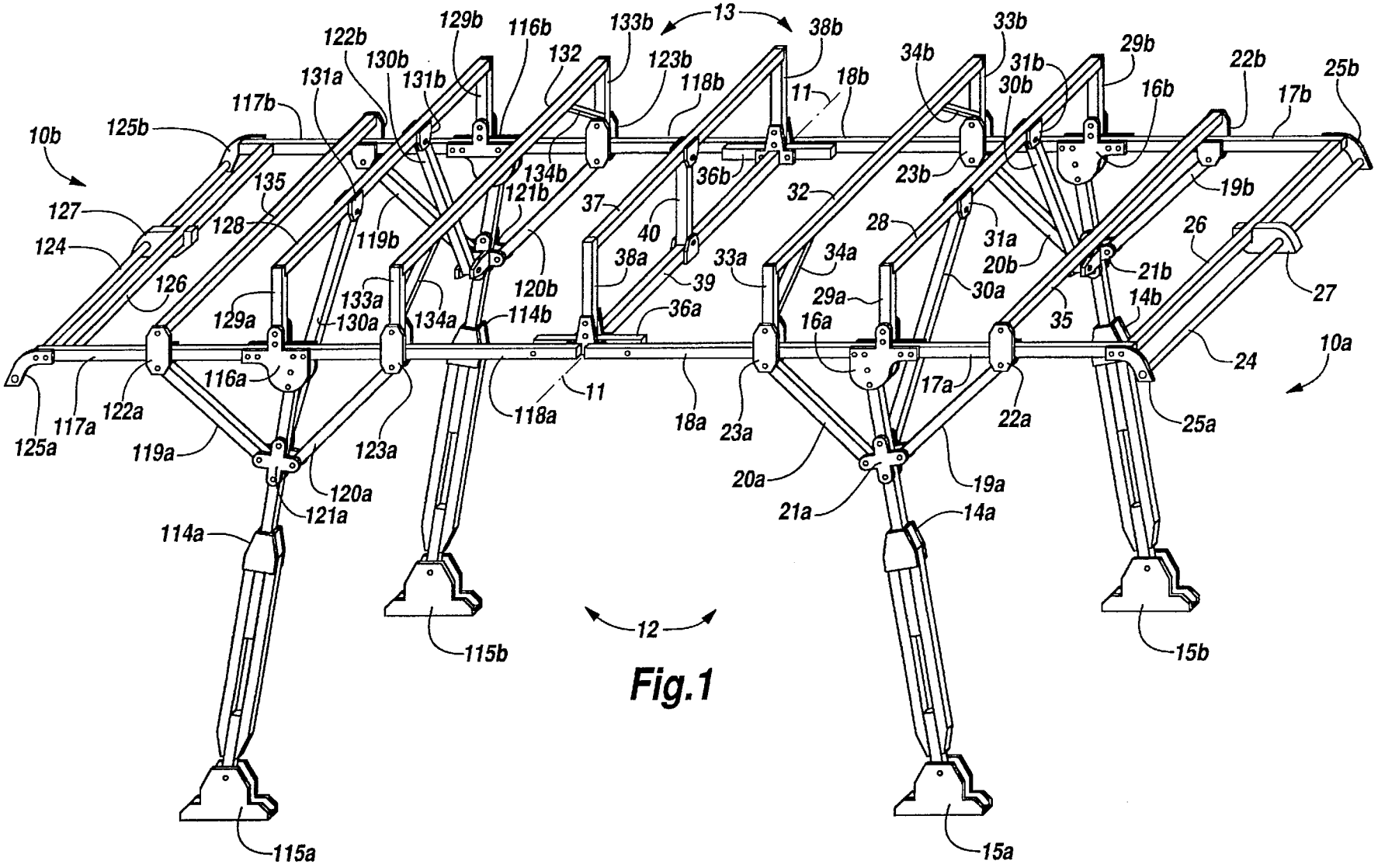
FIG. 1 is a perspective view of one embodiment of the cover supporting erectable shelter structure of my invention.

Referring first to FIG. 1, illustrating one embodiment of the shelter structure of my invention, the structure comprises a front section 10*a* and a rear section 10*b* having identical structural components each arranged to extend oppositely from a common central junction 11. The front and rear sections 10*a* and 10*b* each have a left side 12 and a right side 13 of which the structural components are identical as is evident from the following description. Ground support legs 14*a*, 14*b* are each arranged to extend vertically in the respective left and right sides 12 and 13 of the front section 10*a* with the respective support legs 14*a*, 14*b* having lower ends 15*a*, 15*b* configured for ground engagement and upper ends on which side frame supporting plates 16*a*, 16*b* are mounted. A pair of elongated side frame members 17*a*, 18*a* each have one end connected to the left side ground support leg upper end plate 16*a* and are arranged with the respective side frame members 17*a*, 18*a* of the pair each extending horizontally in opposite directions from the upper end of the ground support leg 14*a* along the front section left side 12. In a similar manner, each of a pair of side frame members 17*b*, 18*b* have one end connected to the right side ground support leg upper plate 16*b* and extend horizontally in opposite directions from the ground support leg along the front section right side 13. A pair of bracing members 19*a*, 20*a* each have their lower ends connected to a cruciform plate 21*a* mounted on the left side ground support leg 14*a* below the upper end plate 16*a* and extend diagonally oppositely upwardly with their upper ends connected respectively to a forward attaching plate 22*a* located medially of the length of the left side frame member 17*a* and a rear attaching plate 23*a* located medially of the left side frame member 18*a*. In a similar manner, each of a pair of bracing members 19*b*, 20*b* extend diagonally oppositely upwardly between a cruciform plate 21*b* mounted on the right side ground support leg 14*b* and attaching plates 22*b* and 23*b* affixed respectively to the right side frame members 17*b*, 18*b*. A cover retaining rod 24 extends transversely across the forward end of the front section 10*a* with opposite ends contained in extension plates 25*a*, 25*b* extending forwardly of the respective side frame members 17*a*, 17*b* between which is affixed an end cross member 26, the midpoint of the rod protruding through an end portion of an auxiliary support 27 of which the other end fits around the cross member 26. A cover supporting rib 28 extending transversely of the front section 10*a* above the left and right side frame members 17*a*, 17*b*, 18*a*, 18*b* has opposite ends affixed to the upper ends of vertically extending support arms 29*a*, 29*b* of which the lower ends are connected respectively to the left and right side ground support leg upper plates 16*a*, 16*b*. The supporting rib 28 is further supported by a pair of truss members 30*a*, 30*b* extending transversely diagonally of the front section 10*a* with lower ends each connected respectively to the cruciform plates 21*a*, 21*b* mounted on the respective left and right side ground support legs 14*a*, 14*b* and upper ends each connected respectively to attaching connections 31*a*, 31*b* spaced apart midway of the cover supporting rib 28. Another transversely extending cover support rib 32 is supported adjacent the central junction 11 similar to rib 28 with opposite ends connected respectively to the upper ends of left and right vertically extending support arms 33*a*, 33*b* of which the lower ends are connected respectively to the left and right side rear brace member attaching plates 23*a*, 23*b* and by truss members 34*a*, 34*b* extending transversely diagonally of the front section 10*a* with lower ends each connected respectively to left and right side rear brace member attaching plates 23*a*, 23*b* and upper ends connected to the cover support rib 32 at locations medially of its length. A lower level transversely extending cover supporting rib 35 is supported forwardly of the ground support legs 14*a*, 14*b* with opposite sides affixed respectively to the left and right side forward brace member attaching plates 22*a*, 22*b*.

As can be seen in FIG. 1, the rear section 10*b* is a mirror image of the front section 10*a* with the component parts forming the respective side and transversely extending structural portions being identical to those of the previously described front section 10*a*. Accordingly, to simplify the description of the embodiment of FIG. 1, the structural components of the rear section 10*b* are designated by the same reference designations used to designate the corresponding components of the front section 10*a* by adding an additional digit, e.g., the ground support legs in the respective left and right sides of the rear section 10*b* are designated 114*a* and 114*b*, the pair of side frame members connected to the left side ground support leg 114*a* and extending in opposite directions along the left side of the rear section are designated 117*a* and 118*a*, the cover supporting rib extending transversely of the rear section 10*b* between upper ends of the ground support legs 114*a* and 114*b* is designated 128, etc. For bridging the respective front and rear sections 10*a*, 10*b* into a composite structure, a connecting bar 36*a* spanning the respective left side frame members 18*a* and 118*a* of the front and rear sections at the junction 11 has its ends connected respectively to the side members 18*a* and 118*a*. A corresponding connecting bar 36*b* is similarly connected across the respective right side frame members 18*b* and 118*b* of the front and rear sections. A central cover supporting rib 37 extending transversely of the respective front and rear sections at the central junction 11 has opposite ends connected to upper ends of a pair of vertically extending rib support arms 38*a*, 38*b* of which the lower ends are connected respectively to the left and right side connecting bars 36*a* and 36*b*. A truss bar 39 extends transversely of the front and rear sections at the central junction 11 with opposite ends connected respectively to the left and right side connecting bars 36*a*, 36*b*, with a reinforcing member 40 extending vertically between midpoints of the truss bar 39 and supporting rib 37.

Figure 3:
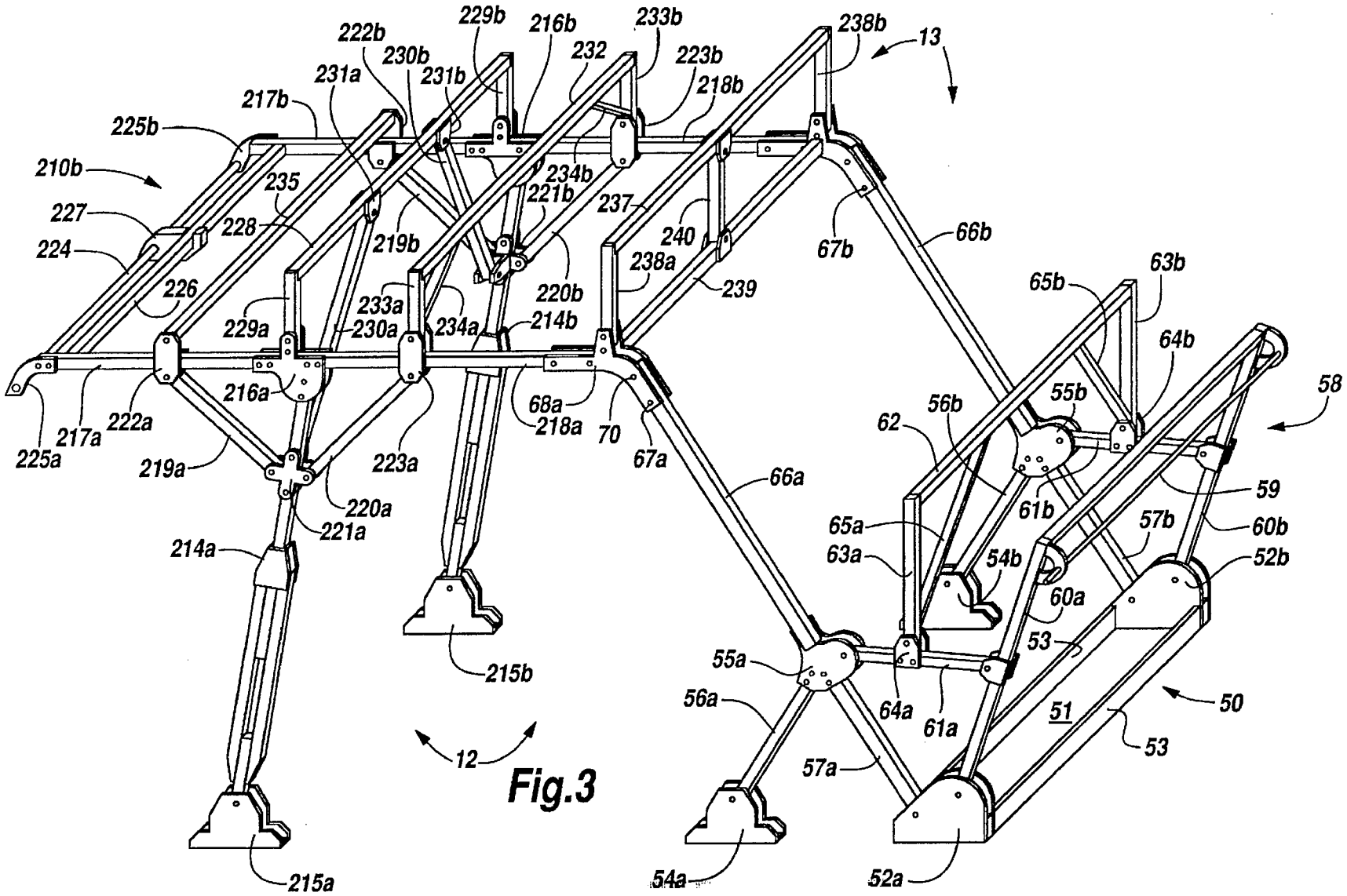
FIG. 3 is a perspective view of a second embodiment of the cover supporting erectable shelter structure of my invention in an extended position.

Referring now to FIG. 3 illustrating another embodiment of the invention, the structure comprises a rear section 210*b* identical to rear section 110*b* of the first embodiment of my invention and a movable front section 50 with each of the front and rear sections having a left side 12 and a right side 13 as in the previously described embodiment. Inasmuch as the component parts of the rear section 210*b* are identical to those of the rear section 110*b* of the first embodiment illustrated in FIG. 1, the respective structural components of the rear section 210*b* are designated in FIG. 3 by the same reference designations used to designate the corresponding components of the rear section 110*b* of the first embodiment by replacing the added first digit "1" with an added first digit "2", e.g., the ground support legs in the respective left and right sides of rear section 210*b* are designated 214*a*, 214*b*, etc.

Referring now to the structural components of the second embodiment front section 50, a base member extending transversely of the front section comprises end plates 52*a*, 52*b* on the respective front section left and right sides connected by a pair of cross members 53 of which the lower edges are configured for ground engagement. A pad 54*a* adapted for ground engagement and spaced rearwardly of the base member left side end plate 52*a* and the end plate provide support for a left side coupling 55*a* spaced vertically above and between the pad 54*a* and the end plate, the coupling being supported by a first support arm 56*a* of which the respective ends are connected to the coupling 55*a* and the left side pad 54*a* and a second support arm 57*a* of which the respective ends are connected to the coupling 55*a* and the base member left side end plate 52*a*. A right side coupling 55*b* is similarly supported above and between the right side pad 54*b* and base member left end plate 52*b* by a first right side coupling support arm 56*b* and a second coupling support arm 57*b*. Provision for retaining a protective cover is provided by a front cover retaining assembly 58 comprising a cover retaining rod 59 extending transversely of the front section 50 of which the respective ends are connected to the top of a pair of vertically extending risers 60*a*, 60*b* having lower ends connected respectively to the base member left and right side end plates 52*a*, 52*b* and left and right side struts 61*a*, 61*b* that extend between the left and right side couplings 55*a*, 55*b* and the left and right riser 60*a*, 60*b* medially of their length. A front section protective cover supporting rib 62 extending transversely of the front section 50 has opposite ends connected to upper ends of a pair of vertically extending rib support arms 63*a*, 63*b* of which the lower ends are connected respectively to the left and right side struts 61*a*, 61*b* at fittings 64*a*, 64*b* medially of the length of the struts. A pair of vertically oriented truss members 65*a*, 65*b* extend diagonally transversely of the front section 50 with lower ends of the respective truss members connected to left and right strut fittings 64*a*, 64*b* and upper ends affixed to the cover supporting rib 62 at spaced apart locations medially of its length.

Figures 4, 5:
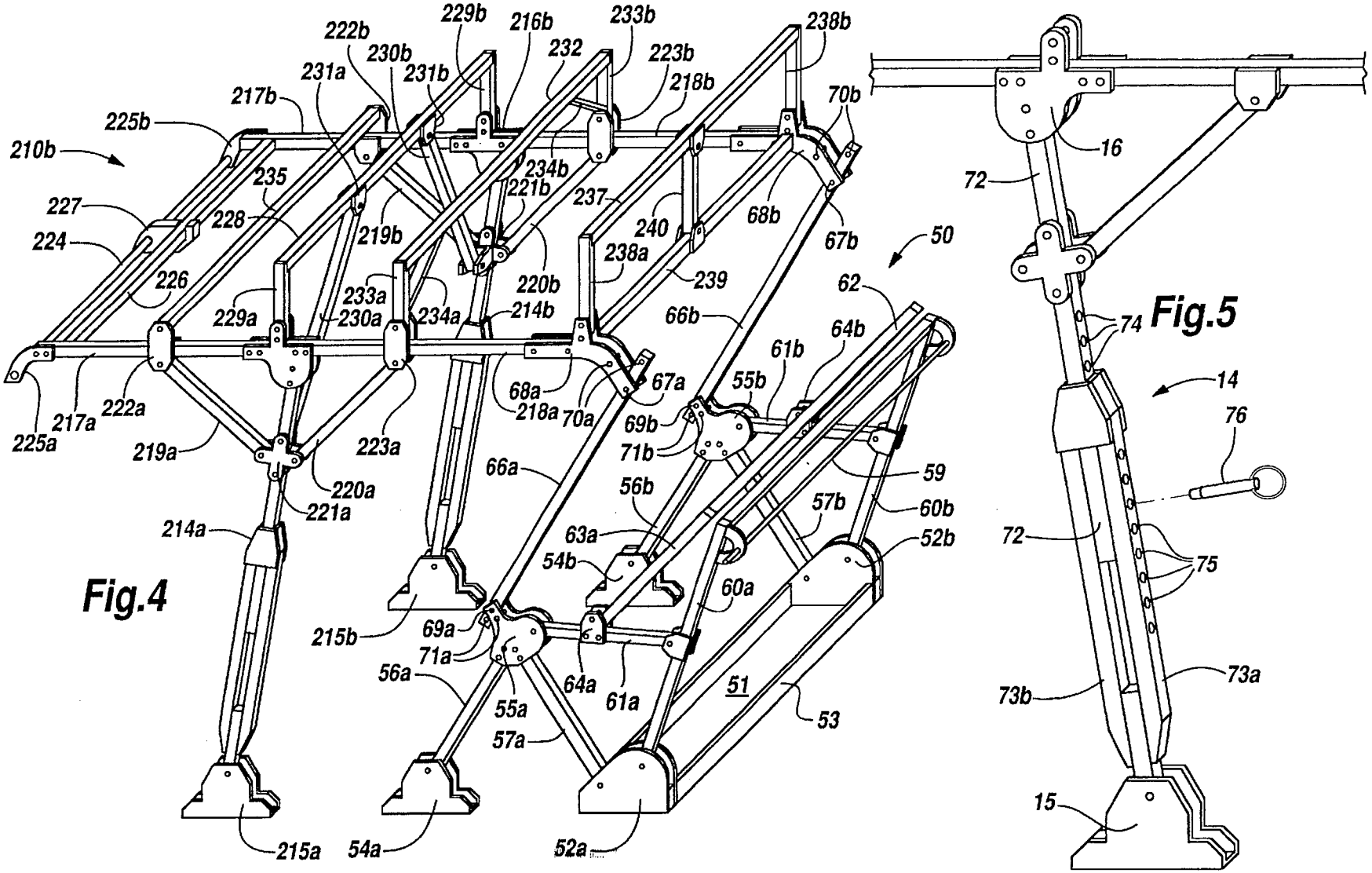
FIG. 4 is a perspective view of the structure of FIG. 3 in a retracted position.
FIG. 5 is a perspective view of a ground support leg component contained in the structures of FIGS. 1, 3 and 4.

As best seen by viewing FIG. 4 along with FIG. 3, the front section 50 is pivotally connected to the rear section 210*b* for movement of the front section between the extended position of FIG. 3 spaced forwardly of the rear section and the retracted position of FIG. 4 adjacent the rear section by a pair of left and right side yoke members 66*a*, 66*b*, each having opposite ends pivotally connected respectively to the front section left and rear side couplings 55*a*, 55*b* and the rear section left and right side frame members 218*a*, 218*b*. A pivot pin 67*a* in the upper end of the left side yoke member 66*a* pivotally connects the left side yoke member upper end to an end plate 68*a* affixed to the outer end of the rear section left side frame member 218*a* and a pivot pin 69*a* at the lower end of the left side yoke member 66*a* pivotally connects the yoke lower end to the left side coupling 55*a*. Locking pin holes 70*a* located in the yoke member 66*a* above the pivot pin 67*a* and in the end plate 68*a* accommodate a locking pin (not illustrated) for locking the front section 50 into an extended position forwardly of the rear section 210*b*. Similarly, locking pin holes 71*a* in the lower end of the left yoke member 66*a* and left side coupling 55*a* perform the same function. Similarly, pivot pins 67*b*, 69*b* in the right side yoke member 66*b* pivotally connect the ends of the right side yoke member 66*b* to the rear section right side frame member end plate 68*b* and front section right side coupling 55*b*, the right side yoke member 66*b* upper end and right side frame member end plate 218*b* similarly containing locking pin holes 70*b* and the right side yoke member 66*b* lower end and right side coupling 55*b* also similarly having similar locking pin holes 71*b*.

Figure 2:
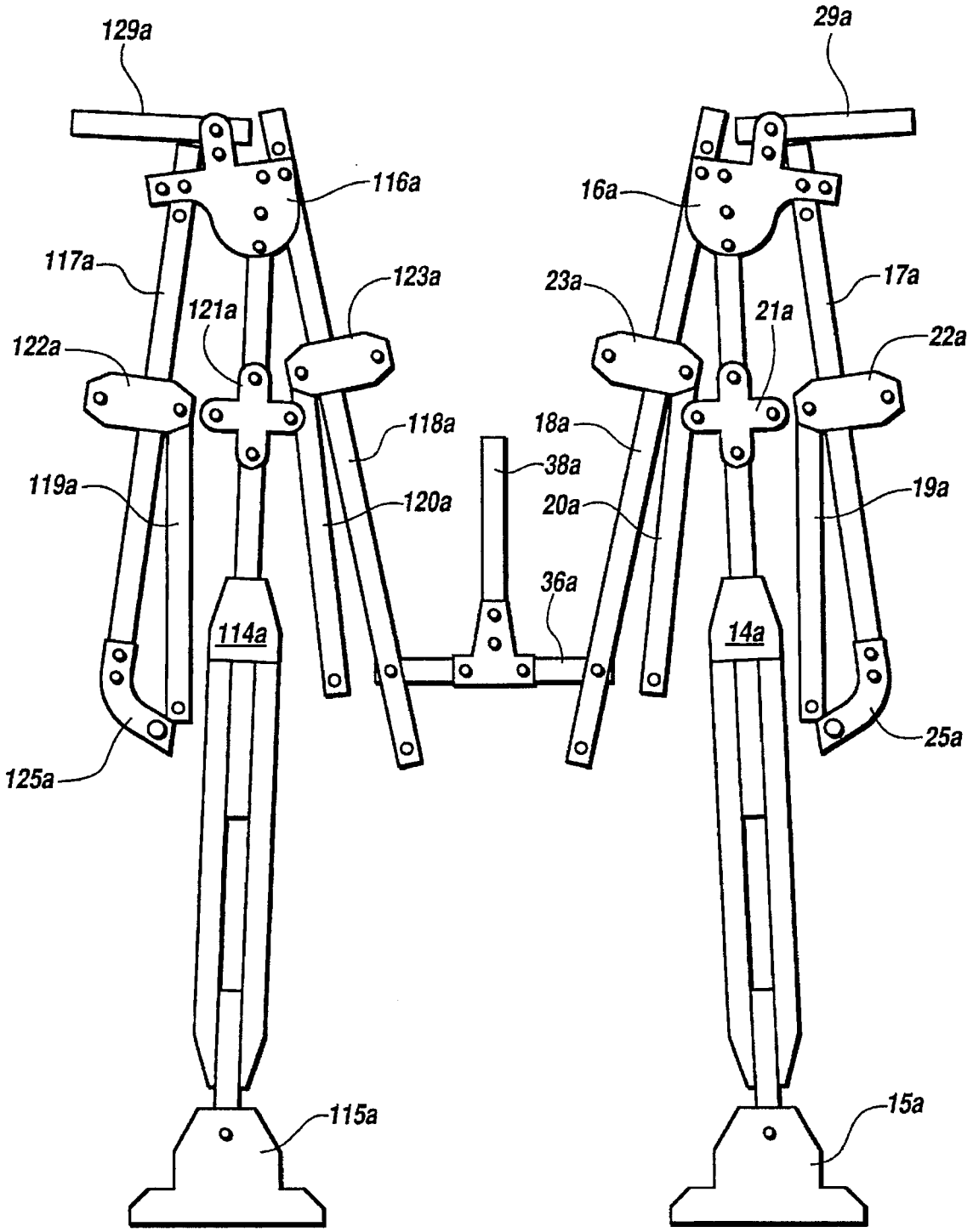
FIG. 2 is a side elevation of structural component parts forming one side of the structure of FIG. 1 with the respective parts partially unlocked and in folded positions.

FIG. 2 illustrates the respective structural members that form the left side of the front and rear sections 10*a*, 10*b* of FIG. 1 embodiment with the members supported by the ground support legs rotated to folded positions about pivots in their respective connections. As is evident without detailed description, the various members contain locking pin holes that accommodate locking pins retaining the members in the erect positions illustrated in FIG. 1.

FIG. 5 illustrates provisions provided in a ground support leg 14 representative of the ground support legs contained in the respective front and rear sections of the embodiment of FIG. 1 and the rear section of the embodiment of FIGS. 3 and 4 that accommodate raising or lowering the upper end of the leg and supported side frame members to selected different heights. Each ground support leg 14 has an upper segment 72 to which is affixed the upper end plate 16 and is slidably contained between respective forward and after side segments 73*a*, 73*b* of the lower portion of the ground support leg terminating at the bottom end 15 configured for ground engagement. A series of locking pin holes 74 spaced apart along the upper segment 72 and a series of locking pin holes 75 along each of the lower segment forward and after sides 73*a*, 73*b* accommodate a locking pin 76 to establish the upper leg segment 72 at different fixed vertical positions relative to the lower ground engaging end 15 of the support leg.

It should be understood that the foregoing disclosure relates only to several preferred embodiments of my invention, and that numerous modifications or alterations therein are possible without departing from the scope of my invention as set forth in the appended claims.

What is claimed is:

1. A cover supporting shelter structure having front and rear sections each having left and right sides and arranged in back-to-back contraposition to extend oppositely outwardly of a common central junction, said shelter structure comprising:

a ground support leg having a lower end adapted for ground engagement and arranged to extend vertically in the respective left and right sides of each said front and rear section, a pair of first and second elongated side frame members supportingly attached to each said ground support leg with said side frame member of each said pair extending horizontally longitudinally along respective ones of each said section side in which said supporting ground support leg is arranged, each side frame member of each said pair having one end connected to an upper end of said supporting ground support leg with respective ones of said first and second side frame members and other ends thereof of each said pair arranged to extend horizontally outwardly from said supporting ground support leg in opposite directions such that said other ends of said second side frame members supported by ground support legs in corresponding ones of said front and rear section left and right sides are in close adjacency at said common central junction, means interconnecting said front and rear section second side frame member other ends located in close adjacency at said common central junction, a brace member extending between each said ground support leg and each said first and second side frame member supported from said ground support leg with said brace member having one end connected to said ground support leg medially of its height and the other end connected to one of said first and second side frame members medially of its length, a plurality of cover support ribs extending transversely of said sections spaced above said side frame members and arranged at spaced intervals along said front and rear section respective left and right sides with opposite end portions of each said rib connected to side frame members in respective ones of said section sides, a truss member extending obliquely between each said ground support leg and a cover support rib with one end of said truss member connected to said ground support leg and the other end connected to said cover support rib medially of its length and a cover retaining rod extending transversely of an outer end of each said section between said section respective left and right sides with opposite ends of each said rod connected to said other end of said first side frame members supported by a ground support leg in corresponding ones of said section sides.

2. The shelter structure of claim 1, wherein said plurality of cover support ribs includes a rib extending transversely of said sections at said common central junction with opposite ends of said rib connected to said second side frame member interconnecting means in respective ones of said section sides.

3. The shelter structure of claim 2, wherein said plurality of cover support ribs includes a rib having opposite ends connected to said side frame member one ends at the location at which said side frame member one ends connects to said ground support leg in respective ones of said front and rear section sides.

4. The shelter structure of claim 2 wherein said truss member one end is affixed to said ground support leg at said medial location of said brace member one end connection and said other end is affixed to a cover support rib having an end connection to said ground support leg.

5. The shelter structure of claim 3, wherein said truss member one end is affixed to said ground support leg at said medial location of said brace member one end connection and said other end is affixed to a cover support rib having an end connection to said ground support leg.

6. The shelter structure of any one of claims 1–5, wherein each said ground support leg has upper and lower segments slidably connected for vertical movement to different separation distances and means retaining said segments at selected separation distances.

7. A cover shelter structure comprising a front section and a rear section each having left and right sides and arranged in back-to-back contraposition each side of a common central junction and interconnected by means for moving said front section between an extended position forwardly of said rear section and a retracted position adjacent said rear section, said front section comprising:

a base member having a lower surface adapted for ground contact extending transversely of said front section and opposite ends disposed in respective ones of said front section left and right sides, a pair of pads each having a lower surface adapted for ground contact and spaced rearwardly of said base member end in respective ones of said front section sides, a pair of couplings each supported in respective ones of said front section sides vertically above and between said base member end and pad by a pair of vertically disposed support arms each having one end connected to said coupling and the other end connected to one of said pad and said base member end, a front cover retaining assembly including:

(a) a cover retaining rod extending transversely of said front section between said front section sides, (b) a pair of vertically extending risers each having a lower end connected a base member end and an upper end connected to said rod end contained in respective said front section sides and (c) a strut extending horizontally between said riser and coupling in each said front section respective sides with one end of said strut connected to said coupling and the other end to said riser medially of its length, a cover support rib extending transversely of said front section spaced above said struts with opposite end portions connected to said strut in respective ones of said front section sides, said rear section comprising:

a ground support leg having a lower end adapted for ground supporting engagement arranged to extend vertically in each of said rear section respective left and right sides, a pair of first and second elongated side frame members supportingly attached to each said ground support leg to extend horizontally longitudinally of respective ones of said rear section left and right sides, each said side frame member of said pair having one end connected to an upper end of said supporting ground support leg with respective ones of said first and second side frame members and other ends thereof of each said pair arranged to extend horizontally outwardly from said supporting ground support leg in opposite directions as establishes the other of said second side frame member ends of each said pair adjacent said common central junction, a brace member extending between each said ground support leg and each said first and second side frame members supported from said ground support leg with each said brace member having one end connected to said ground support leg medially of its height and the other end connected to one of said first and said second side frame members medially of its length, a plurality of cover support ribs extending transversely of said rear section above said side frame members and arranged in a spaced apart relationship along the left and right sides of said rear section with opposite end portions of each said rib connected to a side frame member in respective ones of said rear section sides, a truss member extending obliquely of each said ground support leg and a cover support rib with one end of said truss member connected to said ground support leg and the other end connected to said cover support rib medially of its length and a rear cover retaining rod extending transversely of an outer end of said rear section between respective left and right sides of said rear section with opposite ends of said rod connected to said other end of said first side frame members supported by a ground support leg in corresponding ones of said rear section respective sides, and said interconnecting means comprises a pair of elongated yoke members each having one end pivotally connected to said rear section second side frame member other end adjacent said common central junction and the other end to said front section coupling contained in respective ones of said front and rear section left and right sides.

8. The shelter structure of claim 7, wherein a cover support rib extends transversely of said sections spaced above said rear section side frame members with opposite ends of said rib connected to said second side frame member other ends adjacent said yoke member one end pivotal connection in respective ones of said rear section sides.

9. The shelter structure of claim 8, wherein said plurality of cover support ribs includes a rib having opposite ends connected to side frame member other ends at the location at which said other ends connect to said ground support leg in respective ones of said rear section sides.

10. The shelter structure of claim 9, wherein said plurality of cover support ribs includes a rib extending between side frame members disposed in the respective left and right sides of said rear section at the location of each said brace member connection to a first and second side frame member.

11. The shelter structure of claim 10, wherein each said rear section truss member one end is affixed to said ground support leg at said medial location of said brace member one end connection and said truss member other end is affixed to a cover support rib having an end connection to said ground support leg.

12. The shelter support structure of any one of claims 7–11, wherein each said rear section ground support leg has upper and lower segments slidably connected for vertical movement to different separation distances and means retaining said segments at selected separation distances.

* * * * *